US011763744B2

(12) United States Patent
Du et al.

(10) Patent No.: US 11,763,744 B2
(45) Date of Patent: Sep. 19, 2023

(54) PIXEL DRIVING CIRCUIT AND METHOD FOR CONTROLLING THE SAME, AND DISPLAY APPARATUS

(71) Applicants: Chengdu BOE Optoelectronics Technology Co., Ltd., Chengdu (CN); BOE Technology Group Co., Ltd., Beijing (CN)

(72) Inventors: Shuai Du, Beijing (CN); Hongqing Feng, Beijing (CN)

(73) Assignees: Chengdu BOE Optoelectronics Technology Co., Ltd., Chengdu (CN); BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 17/861,546

(22) Filed: Jul. 11, 2022

(65) Prior Publication Data

US 2022/0351682 A1 Nov. 3, 2022

Related U.S. Application Data

(63) Continuation of application No. 17/264,131, filed as application No. PCT/CN2020/104356 on Jul. 24, 2020, now Pat. No. 11,423,837.

(30) Foreign Application Priority Data

Jul. 26, 2019 (CN) ..... 201910684458.6

(51) Int. Cl.
*G09G 3/3233* (2016.01)

(52) U.S. Cl.
CPC ... *G09G 3/3233* (2013.01); *G09G 2300/0426* (2013.01); *G09G 2300/0852* (2013.01);
(Continued)

(58) Field of Classification Search
CPC ..... G09G 3/3233; G09G 2300/0426; G09G 2300/0852; G09G 2310/061; G09G 2320/0233
See application file for complete search history.

(56) References Cited

U.S. PATENT DOCUMENTS 8,040,303 B2 10/2011 Kim et al.
8,502,751 B2 8/2013 Nathan et al.
(Continued)

FOREIGN PATENT DOCUMENTS

CN 102779497 A 11/2012
CN 104200771 A 12/2014
(Continued)

OTHER PUBLICATIONS

First Office Action, including Search Report, for Chinese Patent Application No. 201910684458.6, dated Jun. 1, 2020, 26 pages.
(Continued)

*Primary Examiner* — Jeff Piziali
(74) *Attorney, Agent, or Firm* — Westman, Champlin & Koehler, P.A.

(57) ABSTRACT

A pixel driving circuit and a method for controlling the same, and a display apparatus are provided. The pixel driving circuit includes a charge storage circuit, a driving circuit and first to third switching circuits. The first switching circuit includes first to third switching elements. Control electrodes of the first and third switching elements are coupled to a reset signal terminal. First electrode of the third switching element is coupled to a fourth node. Second electrode of the second switching element is coupled to a third node. The charge storage circuit includes capacitors coupled in parallel or in series. The first switching circuit is turned on in a first phase and turned off in second and third
(Continued)

phases. The second switching circuit is turned off in the first and second phases and turned on in the third phase.

15 Claims, 5 Drawing Sheets

(52) U.S. Cl.
CPC ..... *G09G 2310/061* (2013.01); *G09G 2320/0233* (2013.01)

(56) References Cited

U.S. PATENT DOCUMENTS

| | | | | |
|---|---|---|---|---|
| 8,836,680 | B2 | 9/2014 | Zebedee | |
| 9,666,132 | B2 | 5/2017 | Wu et al. | |
| 10,186,192 | B2 | 1/2019 | Tong et al. | |
| 10,192,487 | B2 | 1/2019 | Ma | |
| 10,304,381 | B2 | 5/2019 | Han | |
| 10,311,783 | B2 * | 6/2019 | Ma | H01L 27/3276 |
| 10,490,136 | B2 * | 11/2019 | Zhu | G09G 3/3233 |
| 10,657,886 | B2 | 5/2020 | Wang | |
| 11,341,912 | B2 | 5/2022 | Feng | |
| 2009/0096721 | A1 | 4/2009 | Chiou et al. | |
| 2009/0284501 | A1 | 11/2009 | Nathan et al. | |
| 2010/0271314 | A1 * | 10/2010 | Rofougaran | G06F 3/03545 345/173 |
| 2010/0309233 | A1 | 12/2010 | Choi | |
| 2012/0287102 | A1 | 11/2012 | Toyomura et al. | |
| 2013/0033473 | A1 | 2/2013 | Zebedee | |
| 2014/0111506 | A1 | 4/2014 | Zhang et al. | |
| 2016/0005363 | A1 * | 1/2016 | Van Lier | H03M 1/002 345/110 |
| 2016/0180775 | A1 | 6/2016 | Kim | |
| 2017/0193908 | A1 | 7/2017 | Wang | |
| 2018/0090071 | A1 * | 3/2018 | Ma | G09G 3/3233 |
| 2018/0226019 | A1 | 8/2018 | Tong et al. | |
| 2018/0301085 | A1 | 10/2018 | Han | |
| 2019/0385528 | A1 | 12/2019 | Hou et al. | |
| 2021/0335248 | A1 | 10/2021 | Feng | |
| 2021/0398484 | A1 | 12/2021 | Du et al. | |
| 2022/0076631 | A1 | 3/2022 | Dong | |

FOREIGN PATENT DOCUMENTS

| | | | |
|---|---|---|---|
| CN | 102714018 | B | 6/2015 |
| CN | 105336292 | A | 2/2016 |
| CN | 105427800 | A | 3/2016 |
| CN | 105609048 | A | 5/2016 |
| CN | 105632409 | A | 6/2016 |
| CN | 105895028 | A | 8/2016 |
| CN | 105931599 | A | 9/2016 |
| CN | 106803417 | A | 6/2017 |
| CN | 107767813 | A | 3/2018 |
| CN | 108182907 | A | 6/2018 |
| CN | 108281112 | A | 7/2018 |
| CN | 108806605 | A | 11/2018 |
| CN | 110349540 | A | 10/2019 |
| CN | 110619851 | A | 12/2019 |
| KR | 20190057747 | A | 5/2019 |
| WO | 2013018925 | A1 | 2/2013 |
| WO | 2019014935 | A1 | 1/2019 |

OTHER PUBLICATIONS

Second Office Action, including Search Report, for Chinese Patent Application No. 201910684458.6, dated Mar. 15, 2021, 29 pages.
U.S. Patent Office issued prosecution for U.S. Appl. No. 17/264,131, filed Jan. 28, 2021, including: Notice of Allowance and Fees Due (PTOL-85) dated Apr. 14, 2022, 7 pages; Non-Final Rejection dated Dec. 22, 2021, 23 pages; 30 pages total.

* cited by examiner

PIXEL DRIVING CIRCUIT AND METHOD FOR CONTROLLING THE SAME, AND DISPLAY APPARATUS

CROSS-REFERENCE TO RELATED APPLICATION(S)

This application is a continuation application of U.S. patent application Ser. No. 17/264,131, filed on Jan. 28, 2021, which published as U.S. Publication No. 2021/0398484, on Dec. 23, 2021, which is a Section 371 National Stage Application of International Application No. PCT/CN2020/104356, filed on Jul. 24, 2020, entitled "PIXEL DRIVING CIRCUIT AND METHOD FOR CONTROLLING THE SAME, AND DISPLAY APPARATUS", which claims priority to Chinese Patent Application No. 201910684458.6, filed on Jul. 26, 2019, the contents of which are incorporated herein by reference in their entireties.

TECHNICAL FIELD

The present disclosure relates to a field of display technology, and in particular, the present disclosure relates to a pixel driving circuit and a method for controlling the same, and a display apparatus.

BACKGROUND

An active matrix organic light emitting diode display apparatus emits light by current driving. Therefore, electrical properties of thin film transistors directly affect differences of gray-scale brightness of the display apparatus. When the electrical properties of the thin film transistors in different sub-pixels are too large, it is easy to cause uneven image quality, such as Mura (that is, uneven display brightness, which causes various traces).

SUMMARY

In a first aspect, the present disclosure provides a pixel driving circuit, comprising: a charge storage circuit having a first terminal electrically coupled to a first node, and a second terminal electrically coupled to a second node; a driving circuit electrically coupled to the first node, a third node, and a fourth node, and configured to transmit a driving current from the fourth node to the third node under control of the first node; a first switching circuit electrically coupled to a reset signal terminal, the first node, the second node, the third node, the fourth node, and an initialization signal terminal, and configured to provide a potential at the initialization signal terminal to the first node and the third node and electrically couple the second node and the fourth node, under control of the reset signal terminal; a second switching circuit electrically coupled to a light-emitting signal terminal, a first voltage terminal, the fourth node, the third node, and a first electrode of a light emitting element, and configured to provide a potential at the first voltage terminal to the first electrode of the light emitting element under control of the light-emitting signal terminal; and a third switching circuit electrically coupled to a control electrode signal terminal, a data signal terminal, and the second node, and configured to provide a potential at the data signal terminal to the second node under control of the control electrode signal terminal.

In some embodiments, the first switching circuit comprises a first switching element, a second switching element, and a third switching element; and wherein a control electrode of the first switching element, a control electrode of the second switching element, and a control electrode of the third switching element are electrically coupled to a first terminal of the first switching circuit; a first electrode of the first switching element is electrically coupled to a first electrode of the second switching element and to a sixth terminal of the first switching circuit; a second electrode of the first switching element is electrically coupled to a fourth terminal of the first switching circuit; a second electrode of the second switching element is electrically coupled to a fifth terminal of the first switching circuit; a first electrode of the third switching element is electrically coupled to a third terminal of the first switching circuit, and a second electrode of the third switching element is electrically coupled to a second terminal of the first switching circuit.

In some embodiments, the first switching circuit comprises a first switching element, a second switching element, and a third switching element; and wherein a control electrode of the first switching element, a control electrode of the second switching element, and a control electrode of the third switching element are electrically coupled to a first terminal of the first switching circuit; a second electrode of the first switching element is electrically coupled to a first electrode of the second switching element and to a fifth terminal of the first switching circuit; a first electrode of the first switching element is electrically coupled to a sixth terminal of the first switching circuit; a second electrode of the second switching element is electrically coupled to a fourth terminal of the first switching circuit; a first electrode of the third switching element is electrically coupled to a third terminal of the first switching circuit; and a second electrode of the third switching element is electrically coupled to a second terminal of the first switching circuit.

In some embodiments, the second switching circuit comprises a fourth switching element and a fifth switching element; and wherein a control electrode of the fourth switching element and a control electrode of the fifth switching element are electrically coupled to a first terminal of the second switching circuit; a first electrode of the fourth switching element is electrically coupled to a second terminal of the second switching circuit, and a second electrode of the fourth switching element is electrically coupled to a third terminal of the second switching circuit; and a first electrode of the fifth switching element is electrically coupled to a fourth terminal of the second switching circuit, and a second electrode of the fifth switching element is electrically coupled to a fifth terminal of the second switching circuit.

In some embodiments, the third switching circuit comprises a sixth switching element; and wherein a control electrode of the sixth switching element is electrically coupled to a first terminal of the third switching circuit, a first electrode of the sixth switching element is electrically coupled to a second terminal of the third switching circuit, and a second electrode of the sixth switching element is electrically coupled to a third terminal of the third switching circuit.

In some embodiments, the driving circuit comprises a seventh switching element; and wherein a control electrode of the seventh switching element is electrically coupled to a first terminal of the driving circuit, a first electrode of the seventh switching element is electrically coupled to a second terminal of the driving circuit, and a second electrode of the seventh switching element is electrically coupled to a third terminal of the driving circuit.

In some embodiments, each of the first switching element, the second switching element, the third switching element, the fourth switching element, the fifth switching element, the sixth switching element, and the seventh switching element is a thin film transistor, and the control electrode of each switching element is a gate of the thin film transistor, the first electrode of each switching element is a source of the thin film transistor, and the second electrode of each switching element is a drain of the thin film transistor.

In some embodiments, the charge storage circuit comprises a single capacitor electrically coupled between the first node and the second node.

In some embodiments, the charge storage circuit comprises a plurality of capacitors coupled in series between the first node and the second node.

In some embodiments, the charge storage circuit comprises a plurality of capacitors coupled in parallel between the first node and the second node.

In a second aspect, the present disclosure provides a display apparatus comprising a plurality of pixel units, wherein at least one of the plurality of pixel units comprises: the pixel driving circuit described above; and a light emitting element, wherein a second switching circuit in the pixel driving circuit is electrically coupled to a first electrode of the light emitting element, so as to provide a driving current, and a second electrode of the light emitting element is electrically coupled to a second voltage terminal.

In a third aspect, the present disclosure provides a method for controlling a pixel driving circuit described above, comprising that: in a first phase, turning off the second switching circuit and the third switching circuit, and turning on the first switching circuit in response to the first switching circuit receiving a first level at the reset signal terminal, so as to transmit an initialization level at the initialization signal terminal received by the first switching circuit to the first node, so that the driving circuit is turned on, and a level difference between the first terminal of the charge storage circuit and the second terminal of the charge storage circuit becomes a threshold voltage of the driving circuit; in a second phase, keeping the second switching circuit to be turned off, turning off the first switching circuit, turning on the third switching circuit in response to the third switching circuit receiving a first level at the control electrode signal terminal, so as to transmit a data level at the data signal terminal received by the third switching circuit to the second node, so that a level at the first node reaches to be a sum of the data level and the threshold voltage; and in a third phase, keeping the first switching circuit to be turned off, turning off the third switching circuit, and turning on the second switching circuit in response to the second switching circuit receiving a first level at the light-emitting signal terminal, so as to transmit a driving current, which is generated by the driving circuit based on a potential at the first node and a potential at the fourth node, to the first electrode of the light emitting element.

In some embodiments, turning on the first switching circuit in response to the first switching circuit receiving a first level at the reset signal terminal, comprises: turning on the first switching element, the second switching element, and the third switching element in response to the control electrode of the first switching element in the first switching circuit, the control electrode of the second switching element in the first switching circuit, and the control electrode of the third switching element in the first switching circuit receiving a first level at the reset signal terminal.

In some embodiments, transmitting an initialization level at the initialization signal terminal received by the first switching circuit to the first node, so that the driving circuit is turned on, and a level difference between the first terminal of the charge storage circuit and the second terminal of the charge storage circuit becomes a threshold voltage of the driving circuit, comprises: transmitting, by the first switching element in the first switching circuit, an initialization level to the first node; transmitting, by the second switching element in the first switching circuit, the initialization level to the third node which is electrically coupled to the second electrode of the seventh switching element in the driving circuit; turning on the seventh switching element in response to the control electrode of the seventh switching element receiving the initialization level at the first node, so that a level at the first electrode of the seventh switching element becomes a difference between the initialization level and a threshold voltage of the seventh switching element; and transmitting, by the third switching element in the first switching circuit, the difference between the initialization level and the threshold voltage of the seventh switching element to the second node, so that a level difference between the first terminal of the charge storage circuit and the second terminal of the charge storage circuit becomes the threshold voltage of the seventh switching element.

In some embodiments, transmitting an initialization level at the initialization signal terminal received by the first switching circuit to the first node, so that the driving circuit is turned on, and a level difference between the first terminal of the charge storage circuit and the second terminal of the charge storage circuit becomes a threshold voltage of the driving circuit, comprises: transmitting, by the first switching element in the first switching circuit, an initialization level to the third node which is electrically coupled to the second electrode of the seventh switching element in the driving circuit; transmitting, by the second switching element in the first switching circuit, the initialization level at the third node to the first node; turning on the seventh switching element in response to the control electrode of the seventh switching element receiving the initialization level at the first node, so that a level at the first electrode of the seventh switching element becomes a difference between the initialization level and the threshold voltage of the seventh switching element; and transmitting, by the third switching element in the first switching circuit, a level of difference between the initialization level and the threshold voltage to the second node, so that a level difference between the first terminal of the charge storage circuit and the second terminal of the charge storage circuit becomes the threshold voltage.

BRIEF DESCRIPTION OF THE DRAWINGS

The above and/or additional aspects and advantages of the present disclosure will become obvious and easy to understand from the following description of the embodiments in conjunction with the accompanying drawings, in which.

DETAILED DESCRIPTION OF EMBODIMENTS

Figure 1:
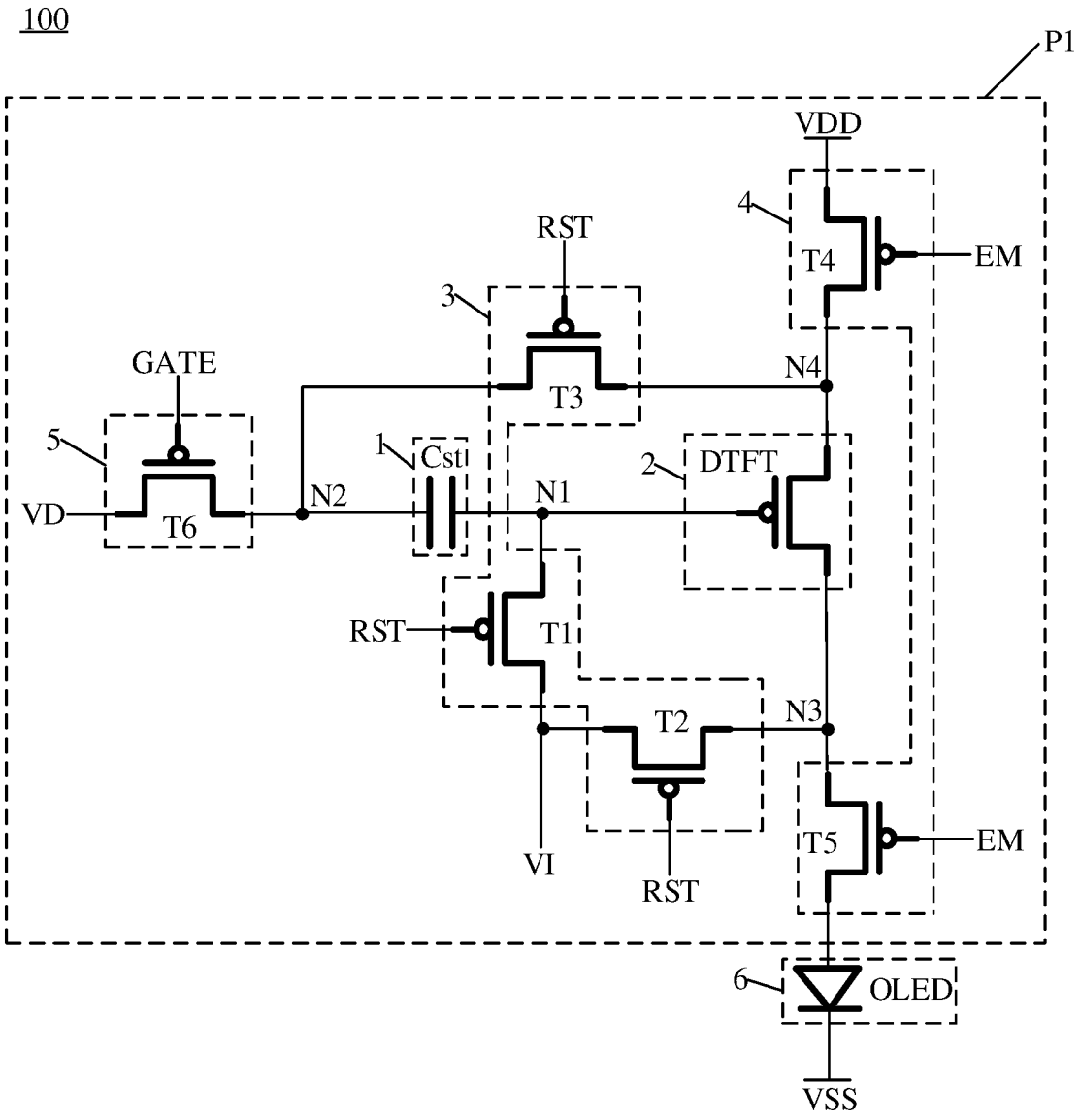
FIG. 1 is a schematic diagram of a part of a structure of a display apparatus provided by an embodiment of the disclosure, including a pixel driving circuit.

The present disclosure will be described in detail below. Examples of embodiments of the present disclosure are shown in the accompanying drawings, where the same or similar reference numerals indicate the same or similar components or components with the same or similar functions. In addition, if a detailed description of the related art is unnecessary for the illustrated feature of the present disclosure, it may be omitted. The embodiments described below with reference to the accompanying drawings are exemplary, used to explain the present disclosure, and may not be construed as limiting the present disclosure.

Those skilled in the art may understand that, unless otherwise defined, all terms (including technical and scientific terms) used herein have the same meanings as those commonly understood by those of ordinary skill in the art to which this disclosure belongs. It should also be understood that terms such as those defined in general dictionaries should be understood as having a meaning consistent with the meaning in the context of the related art, and unless specifically defined as here, they will not be interpreted in ideal or overly formal meanings.

Those skilled in the art may understand that, unless specifically stated otherwise, the singular forms "a", "an", "said" and "the" used herein may also include plural forms. It should be further understood that the term "comprising" used in the specification of this disclosure refers to the presence of the described features, integers, steps, operations, elements and/or components, but does not exclude the presence or addition of one or more other features, integers, steps, operations, elements, components, and/or groups thereof. The term "and/or" used herein includes all or any unit and all combinations of one or more associated listed items.

In the description of the embodiments of the present disclosure, the terms "first level" and "second level" are used to distinguish the two levels from different amplitudes. In some embodiments, the "first level" may be an effective level for turning on the relevant element, and the "second level" may be an invalid level for turning off the relevant element. Hereinafter, the "first level" is exemplified as a low level, and the "second level" is exemplified as a high level.

FIG. 1 shows a schematic diagram of a pixel unit 100 of a display apparatus according to an embodiment of the present disclosure. The pixel unit 100 includes a pixel driving circuit P1 and a light emitting element 6.

The pixel driving circuit P1 includes: a charge storage circuit 1, a driving circuit 2, a first switching circuit 3, a second switching circuit 4, and a third switching circuit 5.

A first terminal of the charge storage circuit 1 and a second terminal of the charge storage circuit 1 are electrically coupled to a first node N1 and a second node N2, respectively. A first terminal to a third terminal of the driving circuit 2 are electrically coupled to the first node N1, a fourth node N4, and a third node N3, respectively.

A first terminal of the first switching circuit 3 to a sixth terminal of the first switching circuit 3 are electrically coupled to a reset signal terminal RST, the second node N2, the fourth node N4, the first node N1, the third node N3, and an initialization signal terminal VI, respectively.

A first terminal of the second switching circuit 4 to a fifth terminal of the second switching circuit 4 are electrically coupled to a light-emitting signal terminal EM, a first voltage terminal VDD, the fourth node N4, the third node N3, and a first electrode of the light emitting element 6 respectively.

A first terminal of the third switching circuit 5 to a third terminal of the third switching circuit 5 are electrically coupled to a control electrode signal terminal GATE, a data signal terminal VD, and the second node N2, respectively.

It should be noted that the first terminal of the charge storage circuit 1 and the first node N1 have a same level, and the second terminal of the charge storage circuit 1 and the second node N2 have a same level.

In the embodiments of the present disclosure, meanings of some parameters are as follows: Vinit is an initialization level, Vdata is a data level, and Vth is a threshold voltage.

In a case that the pixel driving circuit P1 provided by the embodiments of the present disclosure is used to drive the light emitting element 6, the second switching circuit 4 and the third switching circuit 5 may be turned off at a same phase, and in response to the first terminal of the first switching circuit 3 receiving a first level at the reset signal terminal RST, the first switching circuit 3 is turned on, so as to transmit the initialization level Vinit at the initialization signal terminal VI received by the sixth terminal of the first switching circuit 3 to the first node N1, so that the driving circuit 2 is turned on, and a level difference between the first terminal of the charge storage circuit 1 and the second terminal of the charge storage circuit 1 becomes a threshold voltage Vth of the driving circuit 2. At this phase, level data of the first terminal of the charge storage circuit 1 and the second terminal of the charge storage circuit 1 are updated to realize an initialization of the pixel driving circuit P1. As the level difference between the first terminal of the charge storage circuit 1 and the second terminal of the charge storage circuit 1 becomes the threshold voltage Vth of the driving circuit 2, an internal compensation for the threshold voltage Vth of the driving circuit 2 is realized. As the initialization process of the pixel driving circuit P1 and the internal compensation process for the threshold voltage Vth may be performed at a same phase, an impact of a resolution and a refresh frequency of the display apparatus on the internal compensation duration may be avoided, so that the pixel driving circuit using the internal compensation may be applied to high-frequency display apparatuses.

Moreover, in the pixel driving circuit P1 provided by the embodiments of the present disclosure, a driving current I output by the driving circuit 2 is independent of the threshold voltage Vth, which effectively avoids an influence of an error of the threshold voltage Vth on an image quality of the display apparatus, and ensures a brightness uniformity of a display image.

In addition, in the pixel driving circuit P1 provided by the embodiments of the present disclosure, after the first switching circuit 3 is turned off, a leakage current of the charge storage circuit 1 may be reduced, a charge retention capability of the charge storage circuit 1 may be increased, and a contrast ratio may be improved.

For example, in the pixel driving circuit P1 provided by the embodiments of the present disclosure, as shown in FIG.

1, the first switching circuit 3 includes a first switching element T1, a second switching element T2, and a third switching element T3.

A control electrode of the first switching element T1, a control electrode of the second switching element T2, and a control electrode of the third switching element T3 are collectively used as the first terminal of the first switching circuit 3.

A first electrode of the first switching element T1 is electrically coupled to a first electrode of the second switching element T2, and the first electrode of the first switching element T1 and the first electrode of the second switching element T2 are collectively used as the sixth terminal of the first switching circuit 3; and a second electrode of the first switching element T1 and a second electrode of the second switching element T2 are used as the fourth terminal of the first switching circuit 3 and the fifth terminal of the first switching circuit 3, respectively.

A first electrode and a second electrode of the third switching element T3 are used as the third terminal of the first switching circuit 3 and the second terminal of the first switching circuit 3, respectively.

As shown in FIG. 1, the control electrode of the first switching element T1, the first electrode of the first switching element T1, and the second electrode of the first switching element T1 are electrically coupled to the reset signal terminal RST, the initialization signal terminal VI, and the first node N1, respectively. For example, if the first switching element T1 is a thin film transistor, the control electrode, the first electrode, and the second electrode of the first switching element T1 are a gate, a source, and a drain of the thin film transistor, respectively.

As shown in FIG. 1, the control electrode of the second switching element T2, the first electrode of the second switching element T2, and the second electrode of the second switching element T2 are electrically coupled to the reset signal terminal RST, the initialization signal terminal VI, and the third node N3, respectively. For example, if the second switching element T2 is a thin film transistor, the control electrode, the first electrode, and the second electrode of the second switching element T2 are the gate, source, and drain of the thin film transistor, respectively.

As shown in FIG. 1, the control electrode the third switching element T3, the first electrode the third switching element T3, and the second electrode of the third switching element T3 are electrically coupled to the reset signal terminal RST, the fourth node N4, and the second node N2, respectively. For example, if the third switching element T3 is a thin film transistor, the control electrode, the first electrode, and the second electrode of the third switching element T3 are a gate, a source, and a drain of the thin film transistor, respectively.

Figure 2:
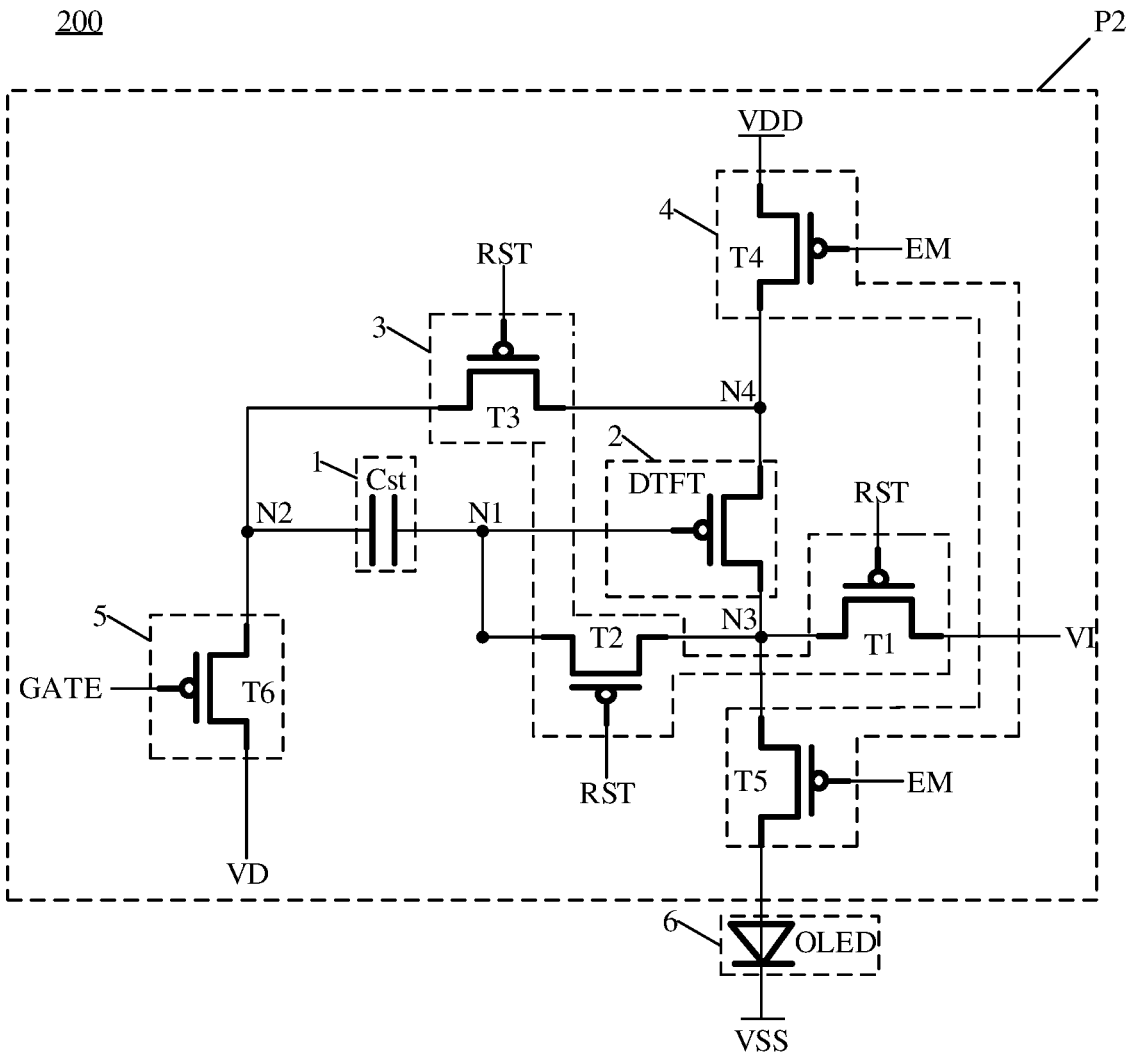
FIG. 2 is a schematic diagram of a part of a structure of a display apparatus provided by an embodiment of the disclosure, including another pixel driving circuit.

FIG. 2 shows a schematic diagram of another pixel unit 200 of a display apparatus according to an embodiment of the present disclosure. The pixel unit 200 includes a pixel driving circuit P2 and a light emitting element 6. The pixel unit 200 has a structure similar to the pixel unit 100 described above, and the differences are described here.

The first switching circuit 3 includes a first switching element T1, a second switching element T2, and a third switching element T3.

A control electrode of the first switching element T1, a control electrode of the second switching element T2, and a control electrode of the third switching element T3 are collectively used as the first terminal of the first switching circuit 3; a second electrode of the first switching element T1 is electrically coupled to a first electrode of the second switching element T2, and the second electrode of the first switching element T1 and the first electrode of the second switching element T2 are collectively used as the fifth terminal of the first switching circuit 3; a first electrode of the first switching element T1 and a second electrode of the second switching element T2 are used as the sixth terminal of the first switching circuit 3 and the fourth terminal of the first switching circuit 3, respectively; and a first electrode of the third switching element T3 and a second electrode of the third switching element T3 are used as the third terminal of the first switching circuit 3 and the second terminal of the first switching circuit 3, respectively.

As shown in FIG. 2, the control electrode of the first switching element T1, the first electrode of the first switching element T1, and the second electrode of the first switching element T1 are electrically coupled to the reset signal terminal RST, the initialization signal terminal VI, and the third node N3, respectively. For example, if the first switching element T1 is a thin film transistor, the control electrode, the first electrode, and the second electrode of the first switching element T1 are a gate, a source, and a drain of the thin film transistor, respectively.

As shown in FIG. 2, the control electrode of the second switching element T2, the first electrode of the second switching element T2, and the second electrode of the second switching element T2 are electrically coupled to the reset signal terminal RST, the third node N3, and the first node N1, respectively. For example, if the second switching element T2 is a thin film transistor, the control electrode, the first electrode, and the second electrode of the second switching element T2 are a gate, a source, and a drain of the thin film transistor, respectively.

As shown in FIG. 2, the control electrode of the third switching element T3, the first electrode of the third switching element T3, and the second electrode of the third switching element T3 are electrically coupled to the reset signal terminal RST, the fourth node N4, and the second node N2, respectively. For example, if the third switching element T3 is a thin film transistor, the control electrode, the first electrode, and the second electrode of the third switching element T3 are a gate, a source, and a drain of the thin film transistor, respectively.

For example, in the pixel driving circuit P2 provided by the embodiments of the present disclosure, the second switching circuit 4 includes a fourth switching element T4 and a fifth switching element T5.

A control electrode of the fourth switching element T4 and a control electrode of the fifth switching element T5 are collectively used as the first terminal of the second switching circuit 4.

A first electrode of the fourth switching element T4 and a second electrode of the fourth switching element T4 are used as the second terminal of the second switching circuit 4 and the third terminal of the second switching circuit 4, respectively; and a first electrode of the fifth switching element T5 and a second electrode of the fifth switching element T5 are used as the fourth terminal of the second switching circuit 4 and the fifth terminal of the second switching circuit 4, respectively.

As shown in FIG. 1 and FIG. 2, the control electrode of the fourth switching element T4, the first electrode of the fourth switching element T4, and the second electrode of the fourth switching element T4 are electrically coupled to the light-emitting signal terminal EM, the first voltage terminal VDD, and the fourth node N4, respectively. For example, if the fourth switching element T4 is a thin film transistor, the control electrode, the first electrode, and the second electrode of the fourth switching element T4 are a gate, a source, and a drain of the thin film transistor, respectively.

As shown in FIG. 1 and FIG. 2, the control electrode of the fifth switching element T5, the first electrode of the fifth switching element T5, and the second electrode of the fifth switching element T5 are electrically coupled to the light-emitting signal terminal EM, the third node N3, and the first electrode of the light emitting element 6 respectively. For example, if the fifth switching element T5 is a thin film transistor, the control electrode, the first electrode, and the second electrode of the fifth switching element T5 are a gate, a source, and a drain of the thin film transistor, respectively.

For example, in the pixel driving circuit P1 and the pixel driving circuit P2, the fifth terminal of the second switching circuit 4 is electrically coupled to the first electrode of the light emitting element 6, and the second electrode of the light emitting element 6 is electrically coupled to the second voltage terminal VSS.

As shown in FIG. 1 and FIG. 2, the light emitting element 6 may be an OLED (Organic Light Emitting Diode) element. The second electrode of the fifth switching element T5 is electrically coupled to a first electrode of the OLED element, and a second electrode of the OLED element is electrically coupled to the second voltage terminal VSS.

In some embodiments, the first electrode of the OLED element may be an anode, and the second electrode of the OLED element may be a cathode.

For example, in the pixel driving circuit P1 and the pixel driving circuit P2 provided by the embodiments of the present disclosure, the third switching circuit 5 includes a sixth switching element T6. A control electrode of the sixth switching element T6, a first electrode of the sixth switching element T6, and a second electrode of the sixth switching element T6 are used as the first terminal of the third switching circuit 5, the second terminal of the third switching circuit 5, and the third terminal of the third switching circuit 5, respectively.

As shown in FIG. 1 and FIG. 2, the control electrode of the sixth switching element T6, the first electrode of the sixth switching element T6, and the second electrode of the sixth switching element T6 are electrically coupled to the control electrode signal terminal GATE, the data signal terminal VD, and the second node N2, respectively. For example, if the sixth switching element T6 is a thin film transistor, the control electrode, the first electrode, and the second electrode of the sixth switching element T6 are a gate, a source, and a drain of the thin film transistor, respectively.

For example, in the pixel driving circuit P1 and the pixel driving circuit P2 provided by the embodiments of the present disclosure, the driving circuit 2 includes a seventh switching element DTFT. A control electrode, a first electrode, and a second electrode of the seventh switching element DTFT are used as the first terminal of the driving circuit 2, the second terminal of the driving circuit 2, and the third terminal of the driving circuit 2, respectively.

As shown in FIG. 1 and FIG. 2, the control electrode of the seventh switching element DTFT, the first electrode of the seventh switching element DTFT, and the second electrode of the seventh switching element DTFT are electrically coupled to the first node N1, the fourth node N4, and the third node N3, respectively. For example, if the seventh switching element DTFT is a thin film transistor, the control electrode, the first electrode, and the second electrode of the seventh switching element DTFT are a gate, a source, and a drain of the thin film transistor, respectively.

The pixel driving circuit P1 and the pixel driving circuit P2 provided by the embodiments of the present disclosure require three gate signal transmission terminals, such as the reset signal terminal RST, the light-emitting signal terminal EM, and the control electrode signal terminal GATE. The first switching element T1, the second switching element T2, and the third switching element T3 receive a same signal from the reset signal terminal RST, and the fourth switching element T4 and the fifth switching element T5 receive a same signal from the light-emitting signal terminal EM, which effectively reduces types of control signal lines and control signals, and simplifies a structure of the pixel driving circuit, and reduces a power consumption.

For example, in the pixel driving circuit P1 and the pixel driving circuit P2 provided by the embodiments of the present disclosure, the charge storage circuit 1 includes at least one capacitor Cst.

As shown in FIG. 1 and FIG. 2, if the charge storage circuit 1 includes a capacitor Cst, for example, a first terminal of the capacitor Cst and a second terminal of the capacitor Cst are used as the first terminal of the charge storage circuit 1 and the second terminal of the charge storage circuit 1, respectively.

Taking FIG. 1 as an example, a terminal point on right side of the capacitor Cst is the first terminal of the capacitor Cst, and a terminal point on left side of the capacitor Cst is the second terminal of the capacitor Cst. The first terminal of the capacitor Cst and the second terminal of the capacitor Cst are electrically coupled to the first node N1 and the second node N2, respectively.

If the charge storage circuit 1 includes a plurality of capacitors Cst coupled in series, a first terminal of a first capacitor Cst and a second terminal of a last capacitor Cst are used as the first terminal of the charge storage circuit 1 and the second terminal of the charge storage circuit 1, respectively.

Figure 3A:
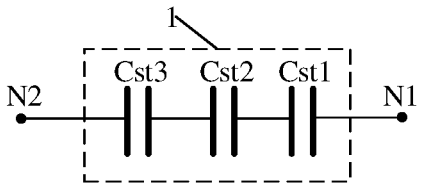
FIG. 3A is a schematic structural diagram of a charge storage circuit provided by an embodiment of the disclosure.

As shown in FIG. 3A, the three capacitors Cst are arranged from right to left in FIG. 3A, the rightmost capacitor Cst is the first capacitor Cst1, the leftmost capacitor Cst is the last capacitor Cst3, and the terminal point on the right side of the capacitor Cst1 is the first terminal of the capacitor Cst, the terminal point on the left side of the capacitor Cst3 is the second terminal of the capacitor Cst. The first terminal of the capacitor Cst is electrically coupled to the first node N1, and the second terminal of the capacitor Cst is electrically coupled to the second node N2.

Figure 3B:
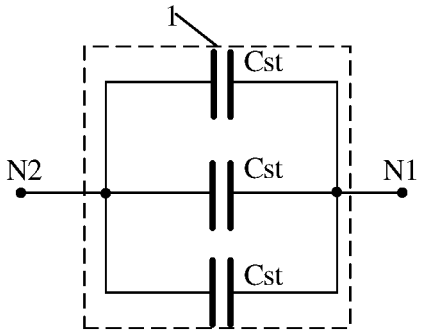
FIG. 3B is a schematic structural diagram of another charge storage circuit provided by an embodiment of the disclosure.

In some embodiments, the charge storage circuit 1 may include a plurality of capacitors Cst coupled in parallel to improve the capacity of the charge storage circuit 1. As shown in FIG. 3B, a plurality of capacitors Cst are arranged from top to bottom in FIG. 3B, one terminal of the capacitors coupled in parallel is electrically coupled to the first node N1, and another terminal of the capacitors coupled in parallel is electrically coupled to the second node N2.

Figure 4:
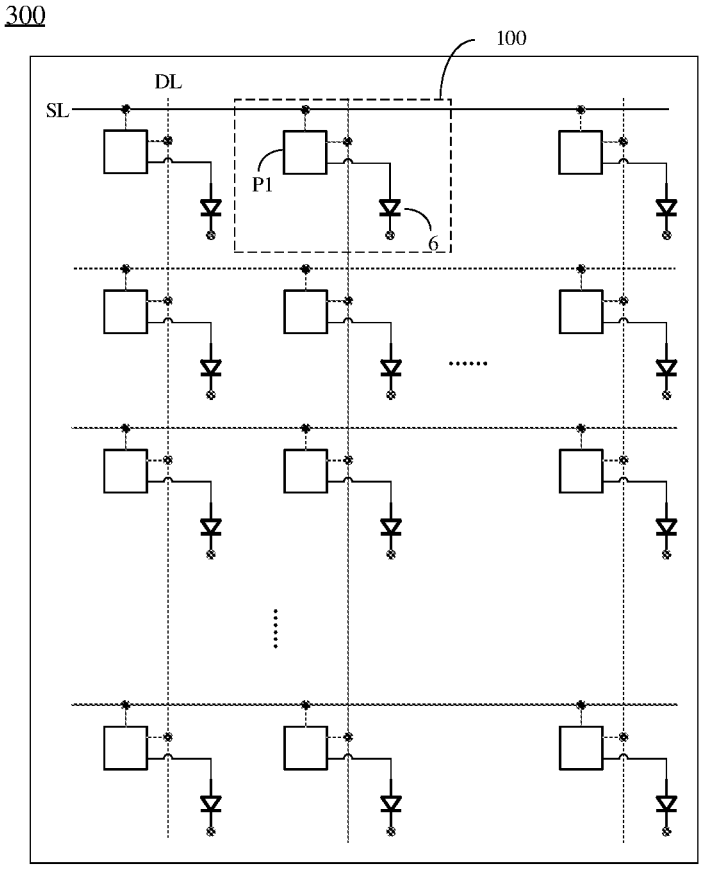
FIG. 4 is a schematic diagram of a display apparatus provided by an embodiment of the disclosure.

Based on the same concept, FIG. 4 shows a display apparatus 300 provided by the embodiments of the present disclosure. The display apparatus 300 includes a plurality of scan lines SL; a plurality of data lines DL cross the plurality of scan lines SL; and a plurality of pixel units 100 arranged in a form of a matrix at an intersection of each scan line and each data line and electrically coupled to the corresponding data line DL and scan line SL. Each of the plurality of pixel units 100 is provided with a pixel circuit P1 and a light emitting element 6 according to an embodiment of the present disclosure, for example, according to the pixel unit shown in FIG. 1.

When the display apparatus 300 of FIG. 4 is implemented by the pixel unit 100, the data signal terminal VD in the pixel unit 100 receives a data signal from the corresponding data line DL, and the control electrode signal terminal GATE in the pixel unit 100 receives a scan signal from the corresponding scan line SL.

In some embodiments, the display apparatus 300 may also be implemented by the pixel unit 200 described above or pixel units of other structures.

The display apparatus 300 may be any product or component with a display function, such as an electronic paper, a mobile phone, a tablet computer, a television, a monitor, a notebook computer, a digital photo frame, and a navigator.

Figure 5:
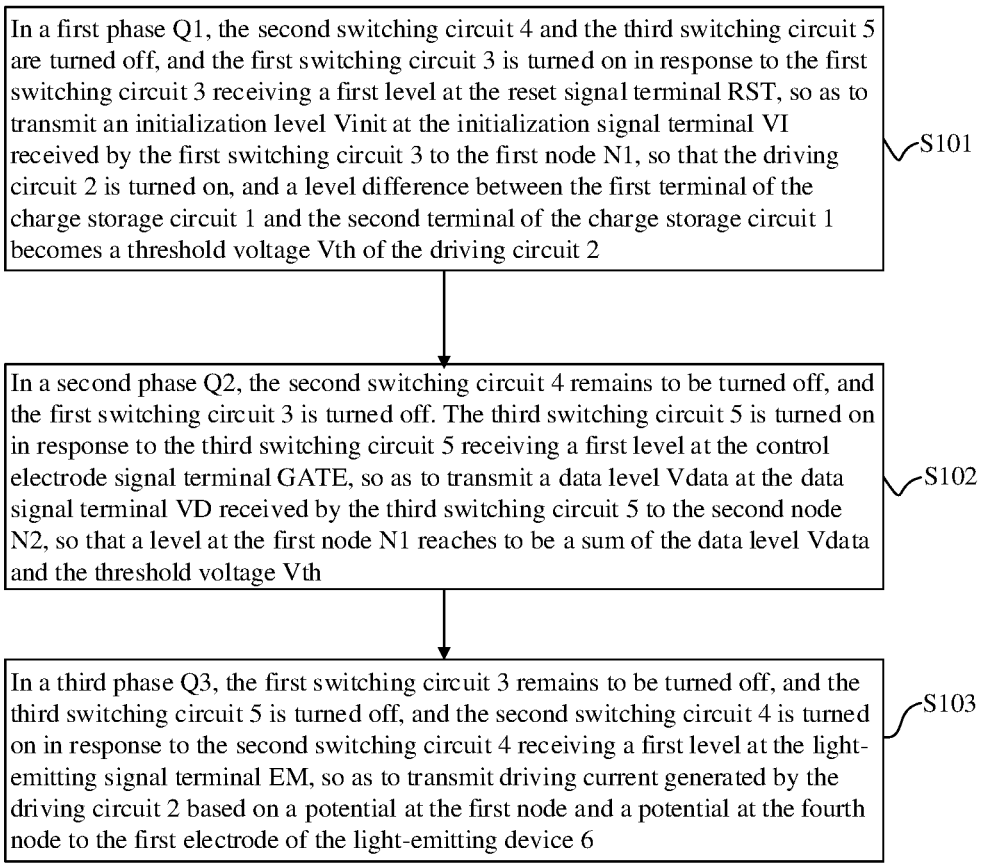
FIG. 5 is a schematic flowchart of a method for controlling a pixel driving circuit according to an embodiment of the disclosure.

Based on the same concept, the embodiments of the present disclosure further provides a method for controlling the pixel driving circuit, and the control method is applied to the pixel driving circuit provided by the embodiments of the present disclosure. It should be noted that, in the pixel driving circuit, the first terminal of the charge storage circuit 1 and the first node N1 have a same level, and the second terminal of the charge storage circuit 1 and the second node N2 have a same level. As shown in FIG. 5, the control method includes the follows.

S101: in a first phase Q1, the second switching circuit 4 and the third switching circuit 5 are turned off, and the first switching circuit 3 is turned on in response to the first switching circuit 3 receiving a first level at the reset signal terminal RST, so as to transmit an initialization level Vinit at the initialization signal terminal VI received by the first switching circuit 3 to the first node N1, so that the driving circuit 2 is turned on, and a level difference between the first terminal of the charge storage circuit 1 and the second terminal of the charge storage circuit 1 becomes a threshold voltage Vth of the driving circuit 2.

S102: in a second phase Q2, the second switching circuit 4 remains to be turned off, and the first switching circuit 3 is turned off. The third switching circuit 5 is turned on in response to the third switching circuit 5 receiving a first level at the control electrode signal terminal GATE, so as to transmit a data level Vdata at the data signal terminal VD received by the third switching circuit 5 to the second node N2, so that a level at the first node N1 reaches to be a sum of the data level Vdata and the threshold voltage Vth.

S103: in a third phase Q3, the first switching circuit 3 remains to be turned off, and the third switching circuit 5 is turned off, and the second switching circuit 4 is turned on in response to the second switching circuit 4 receiving a first level at the light-emitting signal terminal EM, so as to transmit driving current generated by the driving circuit 2 based on a potential at the first node and a potential at the fourth node to the first electrode of the light emitting element 6.

Figure 6:
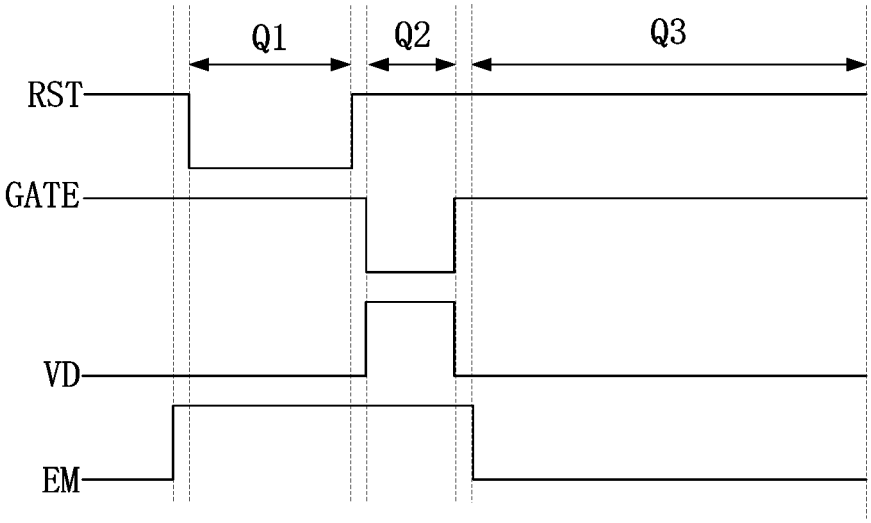
FIG. 6 is a level waveform diagram of the reset signal terminal, the control electrode signal terminal, the data signal terminal, and the light-emitting signal terminal provided by an embodiment of the disclosure in the first to third phases.

FIG. 6 shows waveforms of levels at the reset signal terminal RST, the control electrode signal terminal GATE, the data signal terminal VD, and the light-emitting signal terminal EM provided by an embodiment of the present disclosure in the first phase Q1, the second phase Q2, and the third phase Q3.

In an embodiment of the present disclosure, the reset signal terminal RST may output a first level and a second level, and the first level is less than the second level. The first switching circuit 3 is turned on in response to the first terminal the first switching circuit 3 receiving a first level at the reset signal terminal RST, or the first switching circuit 3 is turned off in response to the first terminal the first switching circuit 3 receiving a second level at the reset signal terminal RST.

In an embodiment of the present disclosure, the light-emitting signal terminal EM may output a first level and a second level, the first level is less than the second level. The second switching circuit 4 is turned on in response to the first terminal of the second switching circuit 4 receiving a first level at the light-emitting signal terminal EM, or the second switching circuit 4 is turned off in response to the first terminal of the second switching circuit 4 receiving a second level at the light-emitting signal terminal EM.

In an embodiment of the present disclosure, the control electrode signal terminal GATE may output a first level and a second level, and the first level is less than the second level. The third switching circuit 5 is turned on in response to the first terminal of the third switching circuit 5 receiving a first level at the control electrode signal terminal GATE, or the third switching circuit 5 is turned off in response to the first terminal of the third switching circuit 5 receiving a second level at the control electrode signal terminal GATE.

It should be noted that the first level at the reset signal terminal RST, the light-emitting signal terminal EM, and the control electrode signal terminal GATE may be equal or different, and the second level at the reset signal terminal RST, the light-emitting signal terminal EM, and the control electrode signal terminal GATE may be equal or different. The values of the first level and the second level may be determined according to actual design requirements. In other embodiments of the present disclosure, the first level may also be greater than the second level.

In the first phase Q1, level data of the first terminal of the charge storage circuit 1 and level data of the second terminal of the charge storage circuit 1 are updated, the level at the first terminal of the charge storage circuit 1 becomes the initialization level Vinit, and the level at the second terminal of the charge storage circuit 1 becomes a difference between the initialization level Vinit and the threshold voltage Vth, that is, the level at the second terminal of the charge storage circuit 1 is (Vinit−Vth). The first phase Q1 completes the initialization of the pixel driving circuit. A level difference between the first terminal of the charge storage circuit 1 and the second terminal of the charge storage circuit 1 becomes the threshold voltage Vth of the driving circuit 2, and the first phase Q1 further completes the internal compensation for the threshold voltage Vth of the driving circuit 2. Since the initialization process of the pixel driving circuit and the internal compensation process for the threshold voltage Vth may be performed at the same phase, this may avoid the impact of the resolution and refresh frequency of the display apparatus on the internal compensation duration, so that the pixel driving circuit adopting the internal compensation may be applied to high-frequency display apparatuses.

In the second phase Q2, the level at the second terminal of the charge storage circuit 1 becomes the data level Vdata output by the data signal terminal VD. According to a bootstrap principle of the charge storage circuit 1, the level at the first terminal of the charge storage circuit 1 becomes a sum of the data level Vdata and the threshold voltage Vth, that is, the level at the first terminal of the charge storage circuit 1 is (Vdata+Vth).

In the third phase Q3, the current output by the first voltage terminal VDD is transmitted to the driving circuit 2, and the driving circuit 2 outputs the corresponding driving current I to the light emitting element 6 according to the level at the first terminal of the charge storage circuit 1, so that the light emitting element 6 emits light with a corresponding brightness.

The driving current I output by the driving circuit 2 is related to the level at the first terminal of the charge storage circuit 1. For example, the driving circuit 2 is a thin film transistor, and the driving current I is expressed as follows:

$$I = \mu C \frac{w}{L}(Vgs - Vth)^2, \quad \text{equation (1)}$$

In equation (1), I is a driving current output by the thin film transistor; u is a carrier mobility of the thin film transistor; C is a capacitance per unit area of the thin film transistor; w is a channel width of the thin film transistor; L is a channel length of the thin film transistor; Vgs is a gate-source level difference of the thin film transistor; and Vth is a threshold voltage of the thin film transistor.

The gate-source level difference Vgs of the thin film transistor is equal to a difference between the level at the first terminal of the charge storage circuit 1 and an output level at the first voltage terminal VDD. The level at the first terminal of the charge storage circuit 1 is (Vdata+Vth), and the output level at the first voltage terminal VDD is Vdd, and equation (1) may be continuously converted into equation (2):

$$I = \mu C \frac{w}{L}((Vdata + Vth - Vdd) - Vth)^2 = \mu C \frac{w}{L}(Vdata - Vdd)^2, \quad \text{equation (2)}$$

It may be seen from the equation (2) that the driving current I output by the driving circuit 2 is related to the data level Vdata, but has nothing to do with the threshold voltage Vth. Therefore, the influence of the error of the threshold voltage Vth on the image quality of the display apparatus is effectively avoided and the brightness uniformity of the display image is guaranteed.

For example, in the control method provided by the embodiments of the present disclosure, the first switching circuit 3 is turned on in response to the first terminal of the first switching circuit 3 receiving the first level at the reset signal terminal RST, including that: the first switching element T1, the second switching element T2, and the third switching element T3 are turned on in response to the control electrode of the first switching element T1 in the first switching circuit 3, the control electrode of the second switching element T2 in the first switching circuit 3, and the control electrode of the third switching element T3 in the first switching circuit 3 synchronously receiving the first level at the reset signal terminal RST.

Those skilled in the art may understand that if the first switching circuit 3 needs to be turned off, the control electrode of the first switching element T1 in the first switching circuit 3, the control electrode of the second switching element T2 in the first switching circuit 3, and the control electrode of the third switching element T3 in the first switching circuit 3 are synchronously receive the second level at the reset signal terminal RST, and the first switching element T1, the second switching element T2, and the third switching element T3 are turned off.

For example, in the control method provided by the embodiments of the present disclosure, for the pixel driving circuit P1 shown in FIG. 1, in the first phase Q1, the initialization level Vinit at the initialization signal terminal VI received by the sixth terminal is transmitted to the first node N1, so as to turn on the driving circuit 2, so that the level difference between the first terminal of the charge storage circuit 1 and the second terminal of the charge storage circuit 1 becomes the threshold voltage Vth of the driving circuit 2. This process includes the following steps:

- the first switching element T1 in the first switching circuit 3 transmits the initialization level Vinit to the first node N1 (at this time, the level at the second terminal of the charge storage circuit 1 is Vinit);
- the second switching element T2 in the first switching circuit 3 transmits the initialization level Vinit to the third node N3 electrically coupled to the second terminal of the seventh switching element DTFT in the driving circuit 2;
- the seventh switching element DTFT is turned on in response to the control terminal of seventh switching element DTFT receiving the initialization level Vinit at the first node N1, so that the level at the first terminal of the seventh switching element DTFT becomes a difference between the initialization level Vinit and the threshold voltage Vth of the seventh switching element DTFT; and the third switching element T3 transmits the difference between the initialization level Vinit and the threshold voltage Vth of the seventh switching element DTFT in the first switching circuit 3 to the second node N2 (at this time, the level at the second terminal of the charge storage circuit 1 is (Vinit−Vth)), so that the level difference between the first terminal of the charge storage circuit 1 and the second terminal of the charge storage circuit 1 becomes the threshold voltage Vth of the seventh switching element DTFT.

For example, in the control method provided by the embodiments of the present disclosure, for the pixel driving circuit P2 shown in FIG. 2, in the first phase Q1, the initialization level Vinit at the initialization signal terminal VI received by the sixth terminal is transmitted to the first node N1, so as to turn on the driving circuit 2, so that the level difference between the first terminal of the charge storage circuit 1 and the second terminal of the charge storage circuit 1 becomes the threshold voltage Vth of the driving circuit 2. This process includes the following steps:

- the first switching element T1 in the first switching circuit 3 transmits the initialization level Vinit to the third node N3 electrically coupled to the second terminal of the seventh switching element DTFT in the driving circuit 2;
- the second switching element T2 transmits the initialization level Vinit at the third node N3 to the first node N1 (at this time, the level at the first terminal of the charge storage circuit 1 is Vinit);
- the seventh switching element DTFT is turned on in response to the control terminal of the seventh switching element DTFT receiving the initialization level Vinit at the first node N1, so that the level at the first terminal of the seventh switching element DTFT becomes a difference between the initialization level Vinit and the threshold voltage Vth of the seventh switching element DTFT; and
- the third switching element T3 in the first switching circuit 3 transmits the difference between the initialization level Vinit and the threshold voltage Vth to the second node N2 (at this time, the level at the second terminal of the charge storage circuit 1 is (Vinit−Vth)), so that the level difference between the first terminal of the charge storage circuit 1 and the second terminal of the charge storage circuit 1 becomes the threshold voltage Vth.

For example, in the control method provided by the embodiments of the present disclosure, the second switching circuit 4 is turned on in response to the first terminal of the second switching circuit 4 receiving a first level at the light-emitting signal terminal EM, which includes that: the control electrode of the fourth switching element T4 in the second switching circuit 4 and the control electrode of the fifth switching element T5 in the second switching circuit 4 synchronously receive the first level at the light-emitting signal terminal EM, and the fourth switching element T4 and the fifth switching element T5 are turned on.

Those skilled in the art may understand that if the second switching circuit 4 needs to be turned off, the control electrode of the fourth switching element T4 in the second switching circuit 4 and the control electrode of the fifth switching element T5 in the second switching circuit 4 synchronously receive a second level at the light-emitting signal terminal EM, and the fourth switching element T4 and the fifth switching element T5 are turned off.

For example, in the control method provided by the embodiments of the present disclosure, the third switching circuit 5 is turned on in response to the first terminal of the third switching circuit 5 receiving the first level at the control electrode signal terminal GATE. This process includes the following steps: the control electrode of the sixth switching element T6 in the third switching circuit 5 receives the first level at the control electrode signal terminal GATE, such that the sixth switching element T6 is turned on.

Those skilled in the art may understand that in order to turn off the third switching circuit 5, the control electrode of the sixth switching element T6 in the third switching circuit 5 receives the second level at the control electrode signal terminal GATE such that the sixth switching element T6 is turned off.

In a case that the pixel driving circuit provided by the embodiments of the present disclosure is used to drive the light emitting element, the second switching circuit and the third switching circuit may be turned off at a same phase, and the first switching circuit is turned on in response to the first terminal of the first switching circuit receiving a first level at the reset signal terminal, so as to transmit the initialization level at the initialization signal terminal received by the sixth terminal of the first switching circuit to the first node, so that the driving circuit is turned on, and a level difference between the first terminal of the charge storage circuit and the second terminal of the charge storage circuit becomes a threshold voltage of the driving circuit. At this phase, level data of the first terminal of the charge storage circuit and the second terminal of the charge storage circuit are updated to realize an initialization of the pixel driving circuit. As the level difference between the first terminal of the charge storage circuit and the second terminal of the charge storage circuit becomes the threshold voltage of the driving circuit, an internal compensation for the threshold voltage of the driving circuit is realized. As the initialization process of the pixel driving circuit and the internal compensation process for the threshold voltage may be performed at a same phase, an impact of a resolution and a refresh frequency of the display apparatus on the internal compensation duration may be avoided, so that the pixel driving circuit using the internal compensation may be applied to high-frequency display apparatuses.

In the pixel driving circuit provided by the embodiments of the present disclosure, the driving current I output by the driving circuit is independent of the threshold voltage, which effectively avoids the influence of errors of the threshold voltage on the image quality of the display apparatus, and ensures the brightness uniformity of the displayed image.

In the pixel driving circuit provided by the embodiments of the present disclosure, after the first switching circuit is turned off, the leakage current of the charge storage circuit may be reduced, the charge retention capability of the charge storage circuit may be increased, and the contrast ratio may be improved.

The pixel driving circuit provided by the embodiments of the present disclosure requires three gate signal transmission terminals, such as the reset signal terminal, the light-emitting signal terminal, and the control electrode signal terminal. The first switching element, the second switching element, and the third switching element receive a same signal from the reset signal terminal, and the fourth switching element and the fifth switching element receive a same signal from the light-emitting signal terminal, which effectively reduces types of control signal lines and control signals, and simplifies a structure of the pixel driving circuit, and reduces a power consumption.

Those skilled in the art may understand that the various operations, methods, steps, measures, and solutions in the process that have been discussed in the present disclosure may be alternated, changed, combined, or deleted. Further, various operations, methods, and other steps, measures, and solutions in the process that have been discussed in the present disclosure may also be alternated, changed, rearranged, decomposed, combined, or deleted. Further, the various operations, methods, steps, measures, and solutions in the process disclosed in the present disclosure in the related art may also be alternated, changed, rearranged, decomposed, combined or deleted.

The terms "first" and "second" are used for descriptive purposes, and may not be understood as indicating or implying relative importance or implicitly indicating the number of indicated technical features. Thus, the features defined with "first" and "second" may explicitly or implicitly include one or more of these features. In the description of the present disclosure, unless otherwise specified, "plurality" means two or more.

It should be understood that although the various steps in the flowchart of the drawings are displayed in sequence according to the instructions of the arrows, these steps are not necessarily executed in the order indicated by the arrows. Unless explicitly stated in this article, there is no strict order for the execution of these steps, and they may be executed in other orders. Moreover, at least part of the steps in the flowchart of the drawings may include multiple sub-steps or multiple phases. These sub-steps or phases are not necessarily executed at the same time, but may be executed at different times, and the order of execution is not must be performed sequentially, but may be performed in turn or alternately with at least a part of other steps or sub-steps or phases of other steps.

The above are part of the embodiments of the present disclosure. It should be pointed out that for those of ordinary skill in the art, without departing from the principles of the present disclosure, several improvements and modifications may be made, and these improvements and modifications should also be made. It is regarded as the protection scope of the present disclosure.

What is claimed is:

1. A pixel driving circuit, comprising:

a charge storage circuit having a first terminal and a second terminal, the first terminal being electrically coupled to a first node;

a driving circuit electrically coupled to the first node, a third node and a fourth node, and configured to transmit a driving current from the fourth node to the third node under control of the first node;

a first switching circuit electrically coupled to a reset signal terminal, the first node, the third node, the fourth node, and an initialization signal terminal, and configured to provide a potential at the initialization signal terminal to the first node under control of the reset signal terminal;

a second switching circuit electrically coupled to a light-emitting signal terminal, a first voltage terminal, the fourth node, the third node, and a first electrode of a light emitting element, and configured to provide a potential at the first voltage terminal to the first electrode of the light emitting element under control of the light-emitting signal terminal; and a third switching circuit electrically coupled to a control electrode signal terminal, a data signal terminal, and the driving circuit, and configured to provide a potential at the data signal terminal to the driving circuit under control of the control electrode signal terminal, wherein the first switching circuit comprises a first switching element, a second switching element, and a third switching element, a control electrode of the first switching element and a control electrode of the third switching element are electrically coupled to the reset signal terminal, a first electrode of the third switching element is electrically coupled to the fourth node, and a second electrode of the second switching element is electrically coupled to the third node;

wherein the charge storage circuit comprises a plurality of capacitors coupled in parallel or a plurality of capacitors coupled in series, wherein each of the plurality of capacitors coupled in parallel has a terminal electrically coupled to the first node and another terminal electrically coupled to the second terminal of the charge storage circuit, and wherein the plurality of capacitors coupled in series are arranged from right to left, a rightmost one of the plurality of capacitors coupled in series is coupled to the first node and a leftmost one of the plurality of capacitors coupled in series is coupled to the second terminal of the charge storage circuit;

wherein the third switching circuit comprises a sixth switching element, wherein a control electrode of the sixth switching element is electrically coupled to the control electrode signal terminal, a first electrode of the sixth switching element is electrically coupled to the data signal terminal, and a second electrode of the sixth switching element is electrically coupled to the second terminal of the charge storage circuit;

wherein the first switching circuit is configured to be turned on in a first phase of a frame in response to the first switching circuit receiving a first level at the reset signal terminal, so as to transmit an initialization level at the initialization signal terminal received by the first switching circuit to the first node, so that the driving circuit is turned on; and to be turned off in a second phase of the frame and a third phase of the frame; and wherein the second switching circuit is configured to be turned off in the first phase and the second phase, and to be turned on in the third phase in response to the second switching circuit receiving a first level at the light-emitting signal terminal, so as to transmit a driving current, which is generated by the driving circuit based on a potential at the first node and a potential at the fourth node, to the first electrode of the light emitting element; and wherein during the first phase, the second switching circuit is kept off while the first switching circuit is kept on, such that an initialization of the pixel driving circuit and an internal compensation for a threshold voltage of the driving circuit are performed simultaneously;

wherein during a time period between the first phase and the second phase, the second switching circuit and the third switching circuit are kept off and the first switching circuit is turned off;

wherein a time period between the first phase and the second phase is continuous with the first phase and the second phase.

2. The pixel driving circuit according to claim 1, wherein the second terminal of the charge storage circuit is electrically coupled to the third switching circuit at a second node, such that the third switching circuit is electrically coupled to the driving circuit through the charge storage circuit; and wherein the first switching circuit is further configured to provide a potential at the initialization signal terminal to the third node and electrically couple the second node and the fourth node, under control of the reset signal terminal.

3. The pixel driving circuit according to claim 1, wherein a control electrode of the second switching element is electrically coupled to the reset signal terminal, a first electrode of the first switching element is electrically coupled to a first electrode of the second switching element and to the initialization signal terminal, and a second electrode of the first switching element is electrically coupled to the first node; and a second electrode of the third switching element is electrically coupled to the second terminal of the charge storage circuit.

4. The pixel driving circuit according to claim 1, wherein the second switching circuit comprises a fourth switching element and a fifth switching element, wherein:

a control electrode of the fourth switching element and a control electrode of the fifth switching element are electrically coupled to the light-emitting signal terminal;

a first electrode of the fourth switching element is electrically coupled to the first voltage terminal, and a second electrode of the fourth switching element is electrically coupled to the fourth node; and a first electrode of the fifth switching element is electrically coupled to the third node, and a second electrode of the fifth switching element is electrically coupled to the first electrode of the light emitting element.

5. The pixel driving circuit according to claim 1, wherein the driving circuit comprises a seventh switching element, wherein a control electrode of the seventh switching element is electrically coupled to the first node, a first electrode of the seventh switching element is electrically coupled to the fourth node, and a second electrode of the seventh switching element is electrically coupled to the third node.

6. The pixel driving circuit according to claim 1, wherein each of the first switching element, the second switching element, and the third switching element is a thin film transistor, and the control electrode of each switching element is a gate of the thin film transistor, the first electrode of each switching element is a source of the thin film transistor, and the second electrode of each switching element is a drain of the thin film transistor.

7. A display apparatus comprising a plurality of pixel units, wherein at least one of the plurality of pixel units comprises:

the pixel driving circuit according to claim 1; and the light emitting element, wherein a second switching circuit in the pixel driving circuit is electrically coupled to a first electrode of the light emitting element, so as to provide a driving current, and a second electrode of the light emitting element is electrically coupled to a second voltage terminal.

8. The display apparatus according to claim 7, wherein the second terminal of the charge storage circuit is electrically coupled to the third switching circuit at a second node, such that the third switching circuit is electrically coupled to the driving circuit through the charge storage circuit; and wherein the first switching circuit is further configured to provide a potential at the initialization signal terminal to the third node and electrically couple the second node and the fourth node, under control of the reset signal terminal.

9. The display apparatus according to claim 7, wherein a control electrode of the second switching element is electrically coupled to the reset signal terminal, a first electrode of the first switching element is electrically coupled to a first electrode of the second switching element and to the initialization signal terminal, and a second electrode of the first switching element is electrically coupled to the first node; and a second electrode of the third switching element is electrically coupled to the second terminal of the charge storage circuit.

10. The display apparatus according to claim 7, wherein the second switching circuit comprises a fourth switching element and a fifth switching element, wherein:

a control electrode of the fourth switching element and a control electrode of the fifth switching element are electrically coupled to the light-emitting signal terminal;

a first electrode of the fourth switching element is electrically coupled to the first voltage terminal, and a second electrode of the fourth switching element is electrically coupled to the fourth node; and a first electrode of the fifth switching element is electrically coupled to the third node, and a second electrode of the fifth switching element is electrically coupled to the first electrode of the light emitting element.

11. The display apparatus according to claim 7, wherein the driving circuit comprises a seventh switching element, wherein a control electrode of the seventh switching element is electrically coupled to the first node, a first electrode of the seventh switching element is electrically coupled to the fourth node, and a second electrode of the seventh switching element is electrically coupled to the third node.

12. The display apparatus according to claim 7, wherein each of the first switching element, the second switching element, and the third switching element is a thin film transistor, and the control electrode of each switching element is a gate of the thin film transistor, the first electrode of each switching element is a source of the thin film transistor, and the second electrode of each switching element is a drain of the thin film transistor.

13. A method for controlling a pixel driving circuit according to claim 1, comprising:

in a first phase, turning off the second switching circuit and the third switching circuit, and turning on the first switching circuit in response to the first switching circuit receiving a first level at the reset signal terminal, so as to transmit an initialization level at the initialization signal terminal received by the first switching circuit to the first node, so that the driving circuit is turned on and a level difference between the first terminal of the charge storage circuit and the second terminal of the charge storage circuit becomes the threshold voltage of the driving circuit;

in a second phase, keeping the second switching circuit to be turned off, turning off the first switching circuit, and turning on the third switching circuit in response to the third switching circuit receiving a first level at the control electrode signal terminal, so as to transmit a data level at the data signal terminal received by the third switching circuit to the second terminal of the charge storage circuit, so that a level at the first node reaches a sum of the data level and the threshold voltage of the driving circuit; and in a third phase, keeping the first switching circuit to be turned off, turning off the third switching circuit, and turning on the second switching circuit in response to the second switching circuit receiving a first level at the light-emitting signal terminal, so as to transmit a driving current, which is generated by the driving circuit based on a potential at the first node and a potential at the fourth node, to the first electrode of the light emitting element.

14. The method according to claim 13, wherein the second terminal of the charge storage circuit is electrically coupled to the third switching circuit at a second node, such that the third switching circuit is electrically coupled to the driving circuit through the charge storage circuit; and wherein the first switching circuit is further configured to provide a potential at the initialization signal terminal to the third node and electrically couple the second node and the fourth node, under control of the reset signal terminal.

15. The method according to claim 13, wherein a control electrode of the second switching element is electrically coupled to the reset signal terminal, a first electrode of the first switching element is electrically coupled to a first electrode of the second switching element and to the initialization signal terminal, and a second electrode of the first switching element is electrically coupled to the first node; and a second electrode of the third switching element is electrically coupled to the second terminal of the charge storage circuit, and wherein turning on the first switching circuit in response to the first switching circuit receiving a first level at the reset signal terminal, comprises: turning on the first switching element, the second switching element, and the third switching element in response to the control electrode of the first switching element in the first switching circuit, the control electrode of the second switching element in the first switching circuit, and the control electrode of the third switching element in the first switching circuit receiving a first level at the reset signal terminal.

* * * * *